US007906893B2

(12) United States Patent
Moribe et al.

(10) Patent No.: US 7,906,893 B2
(45) Date of Patent: Mar. 15, 2011

(54) SPARK PLUG OF INTERNAL COMBUSTION ENGINE HAVING GLAZE LAYERS ON THE SPARK PLUG

(75) Inventors: Mai Moribe, Inazawa (JP); Akira Suzuki, Nagoya (JP); Toshitaka Honda, Iwakura (JP)

(73) Assignee: NGK Spark Plug Co., Ltd., Aichi (JP)

( * ) Notice: Subject to any disclaimer, the term of this patent is extended or adjusted under 35 U.S.C. 154(b) by 419 days.

(21) Appl. No.: 12/056,135

(22) Filed: Mar. 26, 2008

(65) Prior Publication Data

US 2008/0238280 A1 Oct. 2, 2008

(30) Foreign Application Priority Data

Mar. 30, 2007 (JP) ..... 2007-090183
Jan. 16, 2008 (JP) ..... 2008-006392

(51) Int. Cl.
*H01T 13/02* (2006.01)

(52) U.S. Cl. ..... 313/118

(58) Field of Classification Search ..... 313/118–145; 123/169 EL

See application file for complete search history.

(56) References Cited

U.S. PATENT DOCUMENTS

| | | | | |
|---|---|---|---|---|
| 5,859,491 | A | 1/1999 | Nishikawa et al. | |
| 6,111,345 | A * | 8/2000 | Shibata et al. | 313/141 |
| 6,274,971 | B1 | 8/2001 | Sugimoto et al. | |
| 6,765,340 | B2 | 7/2004 | Nishikawa et al. | |
| 2001/0004184 | A1 * | 6/2001 | Ito et al. | 313/143 |
| 2002/0033659 | A1 * | 3/2002 | Nishikawa et al. | 313/118 |
| 2002/0036451 | A1 | 3/2002 | Nishikawa et al. | |
| 2007/0040487 | A1 | 2/2007 | Kyuno et al. | |

FOREIGN PATENT DOCUMENTS

| | | | |
|---|---|---|---|
| CN | 1245356 | A | 2/2000 |
| CN | 1728480 | A | 2/2006 |
| JP | 10-115424 | A | 5/1998 |
| JP | 2000-48931 | A | 2/2000 |
| JP | 2001-319755 | | 11/2001 |
| JP | 2003-7424 | | 1/2003 |
| JP | 2006-236906 | | 9/2006 |
| JP | 2007-80809 | A | 3/2007 |

OTHER PUBLICATIONS

"Road vehicles—M12 × 1,25 spark-plugs with flat seating and 14 mm bi-hexagon and their cylinder head housing"; International Standard; ISO 22977:2005(E); First edition Jul. 15, 2005.

* cited by examiner

*Primary Examiner* — Nimeshkumar D Patel
*Assistant Examiner* — Steven Horikoshi
(74) *Attorney, Agent, or Firm* — Sughrue Mion, PLLC

(57) ABSTRACT

There is provided a spark plug of an internal combustion engine, including a cylindrical metal shell, an insulator retained in the metal shell and having a through hole in an axial direction of the spark plug and a center electrode fitted in the through hole of the insulator. The insulator includes a rear body portion, a middle body portion and a large-diameter portion located between and protruded radially outwardly from the rear and middle body portions to define a rear shoulder section connected to the rear body portion and a front shoulder section connected to the middle body portion. For strength improvements, the insulator has a first glaze layer extending over the rear body portion and the rear shoulder section of the large-diameter portion and a second glaze layer extending over at least part of the middle body portion from some point on the front shoulder section of the large-diameter portion.

15 Claims, 4 Drawing Sheets

SPARK PLUG OF INTERNAL COMBUSTION ENGINE HAVING GLAZE LAYERS ON THE SPARK PLUG

BACKGROUND OF THE INVENTION

The present invention relates to a spark plug of an internal combustion engine. Hereinafter, the term "front" refers to a spark gap side with respect to the direction of an axis of the spark plug, and the term "rear" refers to a side opposite the front side.

A spark plug is generally provided with a cylindrical metal shell, a center electrode and an insulator and mounted on an internal combustion engine for reliable ignition of air-fuel mixture. The insulator has an axial through hole to hold therein the center electrode and includes a front leg portion, a middle body portion, a rear body portion and a large-diameter portion located between and protruded radially outwardly from the rear and middle body portions. The large-diameter portion of the insulator is often formed at a rear end thereof with a rear shoulder section in a curved surface form etc.

The spark plug is exposed to various external stresses such as vibrations due to engine operations and high combustion pressure due to air-fuel mixture combustion. In particular, the rear shoulder section of the insulator is intensively exposed to external stresses. It is thus desired that the insulator has a sufficient level of strength to be protected from cracking under external stresses.

On the other hand, there has been a recent demand for size/diameter reduction of the spark plug. In order to satisfy the spark plug miniaturization demand, it is conceivable to decrease the thickness of the insulator. The insulator however decreases in strength with thickness. As a measure for insulator strength improvement, Japanese Laid-Open Patent Publication No. 2003-7424 proposes to form a glaze layer on a surface of the insulator from the rear body portion to the rear shoulder section so as to reinforce the insulator surface under compressive stress and smoothen fine cracks and holes in the insulator surface. If the glaze layer is too small in thickness, the strength of the insulator cannot be improved to a sufficient level so that there arises a possibility of a crack notably in the rear shoulder section of the insulator. If the glaze layer is too large in thickness, it is likely that a crack will occur on the glaze layer and develop in the insulator. It is thus important to control the thickness of the glaze layer appropriately.

SUMMARY OF THE INVENTION

Even if the rear shoulder section of the insulator attains sufficient strength to withstand relatively high external stress and be protected from cracking under external stress by the formation of the glaze layer with appropriate thickness, the middle body portion of the insulator does not attain sufficient strength to withstand external stress so that the occurrence of cracking in the middle insulator body portion may become pronounced.

It is therefore an object of the present invention to provide a spark plug of an internal combustion engine, having an insulator reinforced by glazing to obtain an improvement in overall strength and prevent a failure such as cracking more assuredly.

According to an object of the present invention, there is provided a spark plug of an internal combustion engine, comprising: a cylindrical metal shell; an insulator retained in the metal shell and having a through hole in an axial direction of the spark plug, the insulator including a rear body portion, a middle body portion and a large-diameter portion located between and protruded radially outwardly from the rear and middle body portions, the large-diameter portion having a rear shoulder section connected at a rear end thereof to a front end of the rear body portion and a front shoulder section connected at a front end thereof to a rear end of the middle body portion; a center electrode fitted in the through hole of the insulator; and a ground electrode joined to the metal shell and having a given portion facing a front end of the center electrode to define a spark gap between the front end of the center electrode and the given portion of the ground electrode, wherein the insulator has first and second glaze layers formed on an outer surface thereof; the first glaze layer extends over the rear body portion and the rear shoulder section of the large-diameter portion; and the second glaze layer extends over at least part of the middle body portion from some point on the front shoulder section of the large-diameter portion.

The other objects and features of the present invention will also become understood from the following description.

DESCRIPTION OF THE EMBODIMENTS

A spark plug 1 for an internal combustion engine according to one exemplary embodiment of the present invention will be described below with reference to the drawings.

Figure 1:
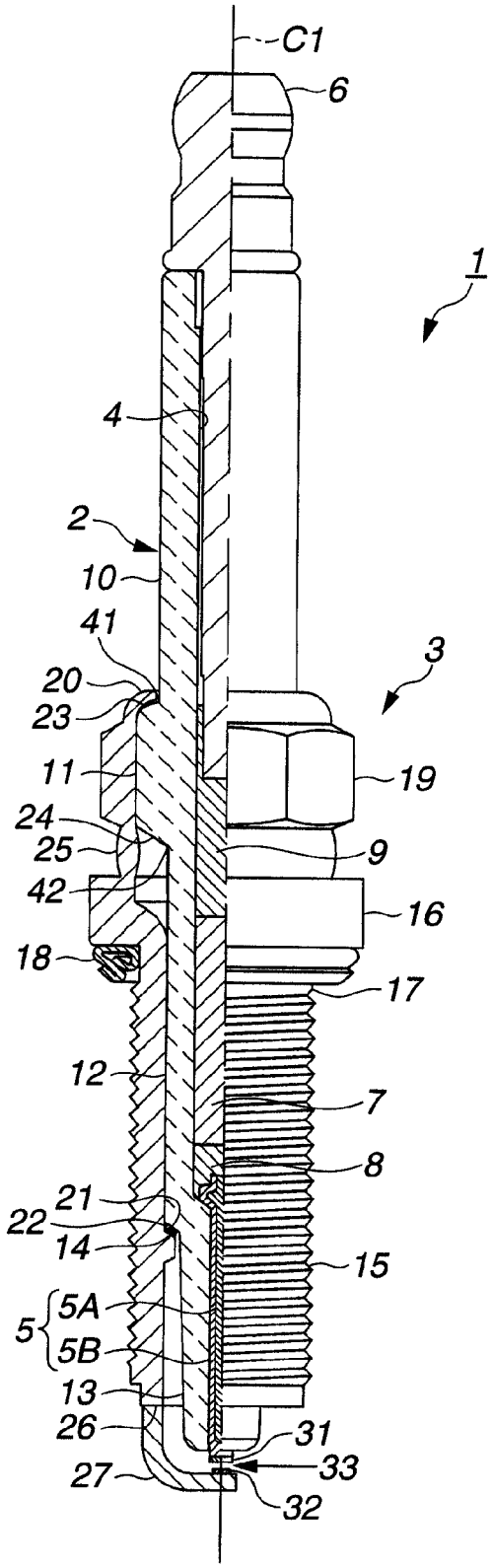
FIG. 1 is a partially cutaway elevation view of a spark plug having a metal shell, a center electrode and an insulator according to one exemplary embodiment of the present invention.
Figure 2:
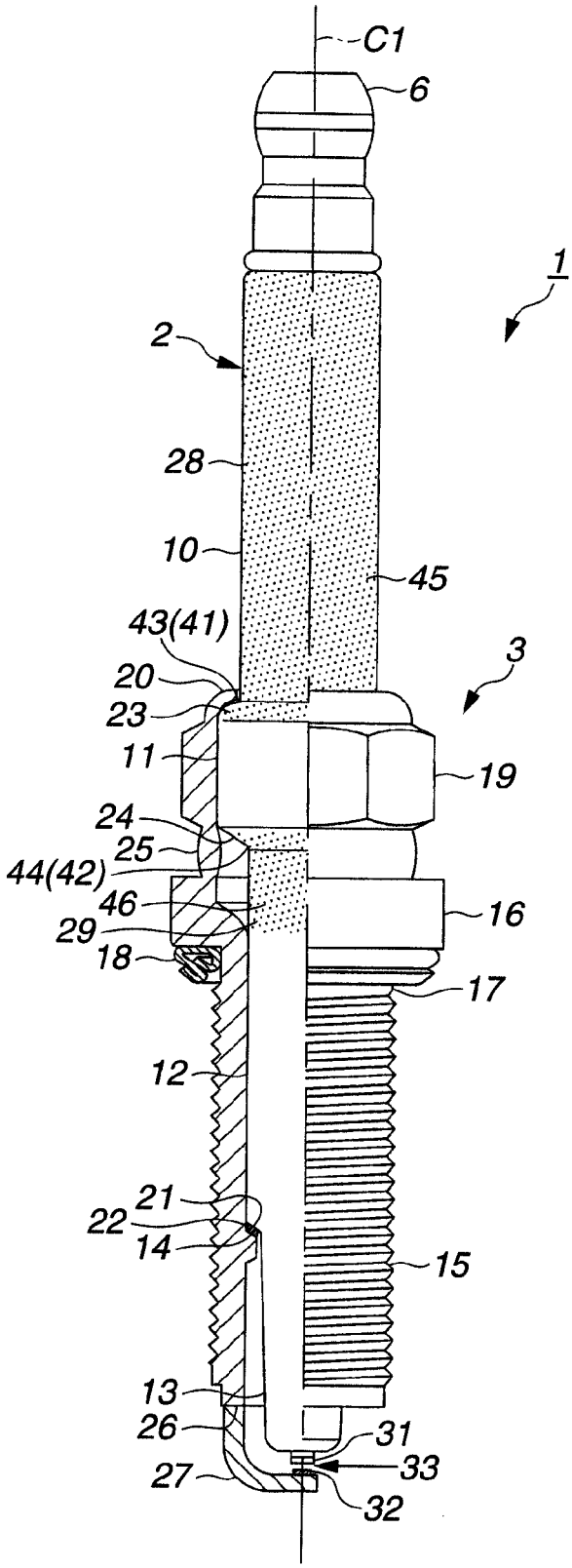
FIG. 2 is a partially cutaway elevation view showing a positional relationship between the metal shell and first and second insulator glaze layers of the insulator according to one exemplary embodiment of the present invention.

Referring to FIGS. 1 and 2, the spark plug 1 includes a ceramic insulator 2, a metal shell 3, a center electrode 5, a terminal electrode 6, a ground electrode 27, a resistive element 7 and conductive glass seal materials 8 and 9.

The ceramic insulator 2 is made of ceramic material such as sintered alumina and formed into a substantially cylindrical shape. More specifically, the ceramic insulator 2 has a through hole 4 in an axial direction C1 of the spark plug 1 and includes a rear body portion 10, a middle body portion 12 and a large-diameter portion 11 continuously located between and protruded radially outwardly from the rear and middle body portions 10 and 12. The large-diameter portion 11 has a rear shoulder section 23 connected at a rear end thereof to a front end of the rear body portion 10 to define a rear corner 41 between the front end of the rear body portion 10 and the rear end of the rear shoulder section 23 and a front shoulder section 24 connected at a front end thereof to a rear end of the middle body portion 12 to define a front corner 42 between the front end of the front shoulder section 24 and the rear end of the middle body portion 12. The rear corner 41 is herein defined as an area including at least a corner boundary across the front end of the rear body portion 10 and the rear end of the rear shoulder section 23. Similarly, the front corner 42 is defined as an area including at least a corner boundary across the front end of the front shoulder section 24 and the rear end of the middle body portion 12. The rear shoulder section 23 can be in a curved surface form or in a continuous or stepwise inclined surface form. The front shoulder section 24 can be in a curved surface form or in a continuous inclined surface form. In the present embodiment, the rear shoulder section 23 and the front shoulder section 24 have a curved surface form and a gradually, continuously inclined surface form, respectively. Further, both of the corners 41 and 42 are L-like shaped in cross section in the present embodiment. The ceramic insulator 2 also includes a front leg portion 13 located on a front side of the middle body portion 12 and having a smaller outer diameter than that of the middle body portion 12 to define a step 14 between the middle body portion 12 and the front leg portion 13.

The metal shell 3 is made of metal material such as iron-based or low-carbon steel material such as S17C or S25C and formed into a substantially cylindrical shape to retain therein the ceramic insulator 2 in such a manner that the front leg portion 13 of the ceramic insulator 2 is partially protruded from a front end of the metal shell 3 and exposed to a combustion chamber of the engine. In the present embodiment, the metal shell 3 includes an external thread portion 15, a plug seat portion 16 and a tool engagement portion 19. The thread portion 15 is made on an outer surface of the metal shell 3 and screwed into a cylinder head (plug hole) of the engine so as to mount the spark plug 1 on the engine cylinder head. A ring-shaped gasket 18 is fitted around a rear thread neck end 17 of the thread portion 15. The plug seat portion 16 is located on a rear side of the thread portion 15 and seated on the engine cylinder head via the gasket 18. The tool engagement portion 19 is located on a rear side of the plug seat portion 16 so as to engage with a tool such as a wrench for mounting the spark plug 1 on the engine cylinder head. Although the tool engagement portion 19 has a hexagonal cross section in the present embodiment, the cross sectional profile of the tool engagement portion 19 is not limited to the hexagonal shape. The tool engagement portion 19 may alternatively be of any other cross sectional profile such as Bi-HEX (bi-hexagonal) according to ISO 22977: 2005(E). Further, the metal shell 3 has an inner diameter reduced stepwisely to define a step 21 on an inner surface thereof. A rear end 20 of the metal shell 3 is crimped onto the ceramic insulator 2 in such a manner that the inner surface of the crimped rear end 20 conforms to the rear shoulder section 23 of the ceramic insulator 2, thereby retaining the ceramic insulator 2 in the metal shell 3 with the step 14 of the ceramic insulator 2 engaged on the step 21 of the metal shell 3. Although the rear end 20 of the metal shell 3 is crimped directly onto the rear shoulder section 23 of the ceramic insulator 2 in the present embodiment, it is alternatively feasible to dispose a pair of ring members filled with talc, or an annular metal plate packing, in a gap between the crimped rear end 20 of the metal shell 3 and the rear shoulder section 23 of the ceramic insulator 2 (i.e. between the outer surface of the ceramic insulator 2 and the inner surface of the metal shell 3). An annular plate packing 22 is arranged between the step 14 of the ceramic insulator 2 and the step 21 of the metal shell 3 to provide a seal between the outer surface of the ceramic insulator 2 and the inner surface of the metal shell 3 and prevent leakage of combustion gas from the engine combustion chamber to the outside through between the ceramic insulator 2 and the metal shell 3.

The center electrode 5 is generally formed into a rod (cylindrical column) shape and fitted in a front side of the insulator axial hole 4 in such a manner that the front portion of the center electrode 5 is partially protruded from a front end of the ceramic insulator 2. In the present embodiment, the front portion of the center electrode 5 tapers down toward the front. Alternatively, the center electrode 5 may be of rod (cylindrical column) shape throughout its length. Further, the center electrode 5 is provided with a body and a tip 31. The body of the center electrode 5 has a two-layer structure consisting of an inner layer 5A of copper or copper alloy and an outer layer 5B of nickel alloy for efficient thermal radiation in the present embodiment. Alternatively, the center electrode body may have a single-layer structure.

The electrode tip 31 is made of known precious metal such as Pt—Ir alloy, formed into a cylindrical column shape and joined to a flattened front end face of the center electrode body by welding (e.g. laser welding, electron-beam welding or resistance welding) of mating surface edges of the center electrode body and the electrode tip 31.

The ground electrode 27 is provided with a body and a tip 32. The body of the ground electrode 27 is made of e.g. nickel alloy (Inconel alloy etc.), joined at a rear end thereof to a front end face 26 of the metal shell 26 and bent into a L-shape to have a given portion e.g. a front end facing the front end of the center electrode 5 (the electrode tip 31). Alternatively, the ground electrode body may be formed by cutting the front end of the metal shell 3 (or a part of a metal attachment to the front end of the metal shell 3) as disclosed in Japanese Laid-Open Patent Publication No. 2006-236906.

The electrode tip 32 is made of known precious metal such as Pt—Ir alloy, formed into a cylindrical column shape and joined to the front end of the ground electrode body by welding (e.g. laser welding, electron-beam welding or resistance welding) of mating surface edges of the ground electrode body and the electrode tip 32.

There is a spark gap 33 defined between the electrode tip 31 and the electrode tip 32 as shown in FIGS. 1 and 2 in the present embodiment. Alternatively, the spark plug 1 may omit either or both of the electrode tips 31 and 32 so that the spark gap 33 is defined between the electrode tip 31 of the center electrode 5 and the body of the ground electrode 27 or between the body of the center electrode 5 and the electrode tip 32 of the ground electrode.

The terminal electrode 6 is fitted in a rear side of the insulator axial hole 4 in such a manner that a rear end of the terminal electrode 6 is protruded from a rear end of the ceramic insulator 2.

The resistive element 7 is disposed between the center electrode 5 and the terminal electrode 6 within the insulator axial hole 4 and electrically connected at front and rear ends thereof to the electrodes 5 and 6 via the glass seal materials 8 and 9, respectively.

Figure 3:
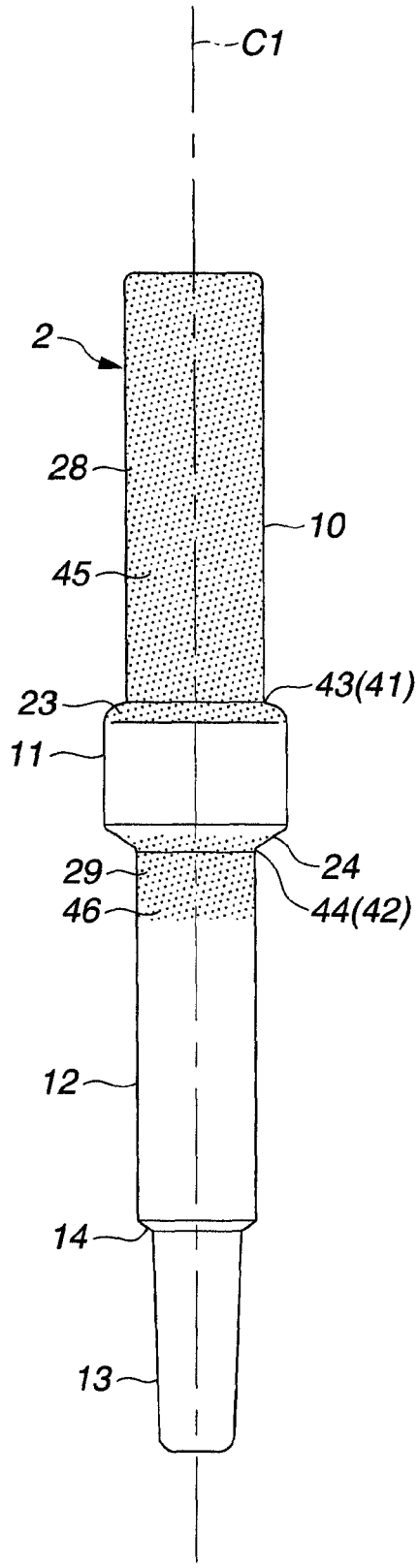
FIG. 3 is an elevation view of positions of the first and second glaze layers on the insulator according to one exemplary embodiment of the present invention.

Additionally, two glaze layers 28 and 29 are formed on the outer cylindrical surface of the ceramic insulator 2 as indicated by dotted hatching in FIGS. 2 and 3. There is no particular restriction on the compositions of the glaze layers 28 and 29. Each of the glaze layers 28 and 29 can be of any appropriate composition such as those disclosed in Japanese Laid-Open Patent Publication No. 2001-319755.

The rear glaze layer 28 (as a first glaze layer) extends over the rear body portion 10 and the rear shoulder section 23. In general, the rear shoulder section 23 is intensively subjected to external mechanical stress. The rear shoulder section 23 is reinforced by the glaze layer 28 so as to withstand such external stress and be protected from cracking.

The front glaze layer 29 (as a second glaze layer) extends over at least part of the middle body portion 12 from some point on the front shoulder section 24. The middle body portion 12 is reinforced by the glaze layer 29 so as to withstand external stress and be protected from cracking. The reinforcement effect of the glaze layer 29 becomes more pronounced when the insulator 2 has a small thickness of 1.3 to 1.65 mm at the front corner 42.

It is accordingly possible to improve both of the strength of the rear shoulder section 23 and the strength of the middle body portion 12 and, by extension, the overall strength of the ceramic insulator 2 and thereby prevent a cracking failure of the ceramic insulator 2 effectively and assuredly by the formation of the glaze layers 28 and 29.

In the present embodiment, the outer diameter of the front shoulder section 24 and the rear part of the middle body portion 12 of the ceramic insulator 2 is smaller than the inner diameter of the corresponding part of the metal shell 3 so that the outer surface of the front shoulder section 24 and the rear part of the middle body portion 12 is spaced away from the inner surface of the corresponding part of the metal shell 3 to leave a relatively large clearance (of about 0.05 to 0.5 mm) therebetween as shown in FIGS. 1 and 2. As shown in FIGS. 2 and 3, the glaze layer 29 is formed to cover the front part of the front shoulder section 24 and the rear part of the middle body portion 12 and is kept from contact with the inner surface of the metal shell 3 in the present embodiment. Even if the thickness of the glaze layer 29 varies, the glaze layer 29 does thus not interfere with the metal shell 3 at the time the ceramic insulator 2 and the metal shell 3 are assembled together. This makes it possible to avoid a workability deterioration during assembling of the ceramic insulator 2 and the metal shell 3 and secure a sufficient gas seal between the ceramic insulator 2 and the metal shell 3 in the assembled state of the ceramic insulator 2 and the metal shell 3. Alternatively, the glaze layer 29 may extend to a front part of the middle body portion 12 to be brought into contact with the metal shell 3. In this case, it is desirable to adjust the outer diameter of the middle body portion 12 and the thickness of the glaze layer 29 etc. in such a manner that the outer diameter of the middle body portion 12 with the glaze layer 29 becomes equal to the inner diameter of the metal shell 3 to minimize the clearance for sufficient gas seal between the ceramic insulator 2 and the metal shell 3 while avoiding workability deterioration during the assembling of the ceramic insulator 2 and the metal shell 3.

More specifically, the rear glaze layer 28 includes a first corner glaze section 43 to cover the rear corner 41 and a first body glaze section 45 located adjacent to the first corner glaze section 43 to cover the rear body portion 10 (from the rear end to near the front end of the rear body portion 10). The front glaze layer 29 also includes a second corner glaze section 44 to cover the front corner 42 and a second body glaze section 46 located adjacent to the second corner glaze section 44 to cover the at least part of the middle body portion 12.

Each of the first and second corner glaze sections 43 and 44 preferably has a thickness of 5 to 150 μm (for example, 10 to 100 μm). In particular, the corners 41 and 42 of the ceramic insulator 2 are intensively subjected to external mechanical stress. When the corner glaze sections 43, 44 have a relatively large thickness of 5 to 150 μm, the corners 41 and 42 attain sufficiently improved strength. In addition, the corner glaze section 43, 44 provides a smoother bend (e.g. more smoothly curved form) to the corner 41, 42 for efficient stress dispersion. The ceramic insulator 2 can thus obtain further improvements in overall strength and be protected from cracking more assuredly. If the thickness of the corner glaze section 43, 44 is smaller than 5 μm, the strength of the corner 41, 42 may not be increased to a sufficient level. If the thickness of the corner glaze section 43, 44 is larger than 150 μm, it is likely that a crack will occur on the corner glaze section 43, 44 and develop in the ceramic insulator 2. For further strength improvements, the thickness of the corner glaze section 43, 44 can be controlled to 10 μm or larger.

Further, each of the first and second body glaze sections 45 and 46 preferably has a thickness of 5 to 30 μm (for example, 10 to 20 μm). When the body glaze sections 45 and 46 have a thickness of 5 to 30 μm, the rear and middle body portions 10 and 12 attain sufficiently improved strength. The ceramic insulator 2 can thus obtain further improvements in overall strength and be protected from cracking more assuredly. If the thickness of the body glaze section 45, 46 is smaller than 5 μm, the strength of the body portion 10, 12 may not be increased to a sufficient level. If the thickness of the body glaze section 45, 46 is larger than 30 μm, it is likely that a crack will occur on the body glaze section 45, 46 and develop in the ceramic insulator 2.

As the rear corner 41 is subjected to external mechanical stress more intensively than the rear body portion 10, the first corner glaze section 43 is preferably made larger in thickness than the first body glaze section 45 for effective strength improvements. Similarly, the second corner glaze section 44 is preferably made larger in thickness than the second body glaze section 46 for effective strength improvements as the front corner 42 is subjected to external mechanical stress more intensively than the middle body portion 12.

The above spark plug 1 can be manufactured by the following procedure.

The metal shell 3 is first produced in a semifinished form by cold forging a cylindrical column metal piece of iron-based or stainless steel material to form an axial through hole in the metal piece, and then, cutting the outside shape of the metal piece.

The body of the ground electrode 27 is joined by resistance welding to the front end face 26 of the metal shell 3. After removing weld shear drops from the joint between the metal shell 3 and the ground electrode 27, the thread portion 15 is formed at a predetermined position on the metal shell 3 by component rolling. The thus-obtained metal shell subassembly unit is given zinc plating or nickel plating. The metal shell subassembly unit may be further treated by chromating for corrosion resistance improvement.

The electrode tip 32 is then joined to the front end of the ground electrode body by resistance welding or laser welding. For reliable welding, it is feasible to remove the plating of the front end surface of the ground electrode body prior to the welding, or to mask the front end surface of the ground electrode body at the welding. Alternatively, the electrode tip 32 may be welded to the front end of the ground electrode body subsequent to the after-mentioned assembling process.

On the other hand, the ceramic insulator 2 is produced by preparing a powder mixture of alumina and binder etc. with a granulation material, molding the ceramic power mixture into a cylindrical shape with a rubber press, shaping the ceramic mold by grinding, sintering the ceramic mold in a furnace, and then, finishing the sintered ceramic mold by various grinding operations.

The center electrode 5 is also produced by forging the electrode layer 5B of nickel alloy and forming the electrode layer 5A of copper or copper alloy in the center of the electrode layer 5B.

The electrode tip 32 is joined to the front end of the center electrode 5 by resistance welding or laser welding.

The ceramic insulator 2, the center electrode 5, the resistive element 7 and the terminal electrode 6 are assembled and fixed together as follows. The glass seal materials 8 and 9 are generally prepared from borosilicate glass and metal powder. The resistive element 7 is inserted into the axial through hole 4 of the ceramic insulator 2, followed by filling the glass seal materials 8 and 9 into the insulator through hole 4 to sandwich the resistive element 7 between the glass seal materials 8 and 9. The center electrode 5 and the terminal electrode 6 are fitted in the front and rear sides of the insulator though hole 4 by baking the glass seal materials 8 and 9 with these electrodes 5 and 6 placed under pressure. At this time, the glaze layers 28 and 29 are formed concurrently. Either or both of the glaze layers 28 and 29 may alternatively be formed in advance.

The metal shell and insulator subassembly units are assembled and fixed together by hot crimping. In this hot crimping process, the metal shell 3 is crimped at the rear end 20 onto the ceramic insulator 2 under the condition that a thin portion 25 of the metal shell 3 between the plug seat portion 16 and the tool engagement portion 19 is heated for reduction in deformation resistance. This allows crimping of the metal shell 3 due to not only plastic deformation but also difference in thermal expansion between the metal shell 3 and the ceramic insulator 2. When the thin portion 25 gets cooled from the thermally expanded state and contracts in the plug axial direction C1, the crimped metal shell end 20 forces the rear shoulder section 23 toward the front. With this, the ceramic insulator 2 is fixed securely in the metal shell 3 by engagement between the step 14 of the ceramic insulator 2 and the step 21 of the metal shell 3. In the assembled state, the ceramic insulator 2 is held under stress in the plug axial direction C.

Finally, the ground electrode 27 is bent in such a manner as to define the spark gap 33 between the electrode tips 31 and 32.

The present invention will be described in more detail by reference to the following examples. It should be however noted that the following examples are only illustrative and not intended to limit the invention thereto.

Experiment 1

Fifty-two test samples of the spark plug 1 were manufactured by the above-mentioned procedure, except that the front glaze layer 29 was not formed (i.e., on the rear glaze layer 28 was formed). The thickness of the first body glaze section 45 of the glaze layer 28 varied from sample to sample.

Figure 4:
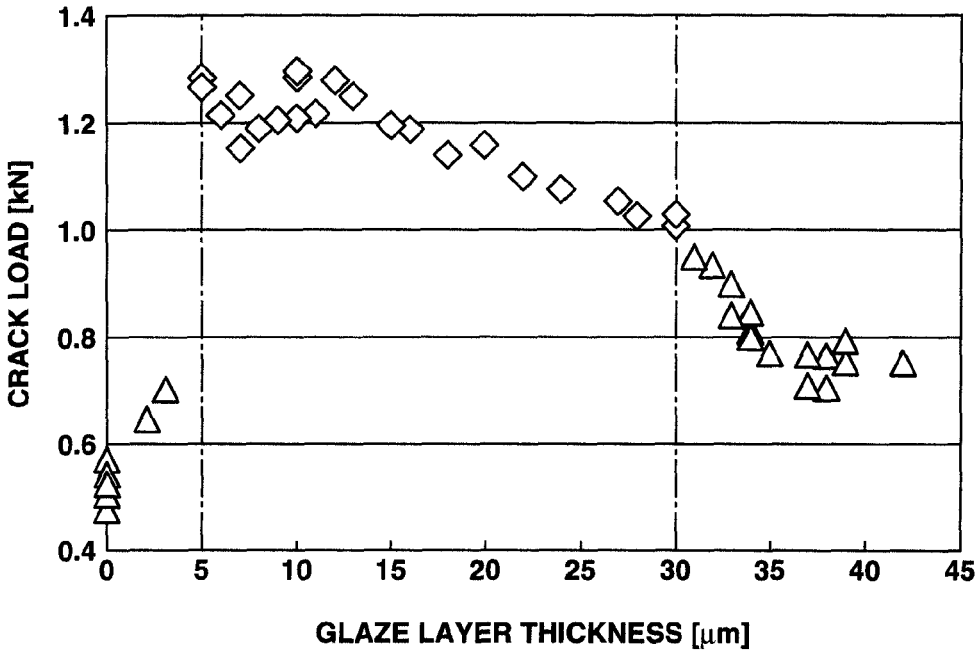
FIG. 4 is a graph of bending test results regarding a relationship of insulator crack position, crack load and first body glaze thickness.

The test samples were subjected to bending strength test. The bending strength test was conducted as follows. The spark plug 1 was mounted on a test stand, with the axis of the spark plug 1 horizontally oriented, by screwing the thread portion 15 into a screw hole of the test stand with a tightening torque of 25 N·m. Using an autograph, a vertical load was applied from above to the terminal electrode 6. The load was gradually increased. The load under which a crack occurred in the ceramic insulator 2 was measured as a crack load. Further, the position of the crack in the ceramic insulator 2 was identified. The test results are indicated in FIG. 4. In FIG. 4, the triangular plots indicate the occurrence of cracking in the rear shoulder section 23 of the ceramic insulator 2 and the quadrangular plots indicate the occurrence of cracking in the middle body portion 12 of the ceramic insulator 2. Further, the first body glaze thickness of 0 mm means the absence of the rear glaze layer 28.

As shown in FIG. 4, the rear shoulder section 23 of the ceramic insulator 23 was cracked even under relatively small loads when the thickness of the first body glaze section 45 was less than 5 μm. When the thickness of the first body glaze section 45 exceeded 30 μm, the rear shoulder section 23 of the ceramic insulator 23 was also cracked even under relatively small loads. In addition, the crack load (i.e. the maximum load which the ceramic insulator 2 could withstand without cracking) decreased with increase in the thickness of the first body glaze section 45. On the other hand, the crack was prevented from occurring in the rear shoulder section 23, but did occur in the middle body portion 12 of the ceramic insulator 2 under relatively large loads, when the thickness of the first body glaze section 45 was in the range of 5 to 30 μm.

Experiment 2

Test samples of the spark plug 1 were manufactured by the above-mentioned procedure, except that the front glaze layer 29 was not formed (i.e., on the rear glaze layer 28 was formed). The thickness of the first corner glaze section 43 of the glaze layer 28 varied from sample to sample.

Figure 5:
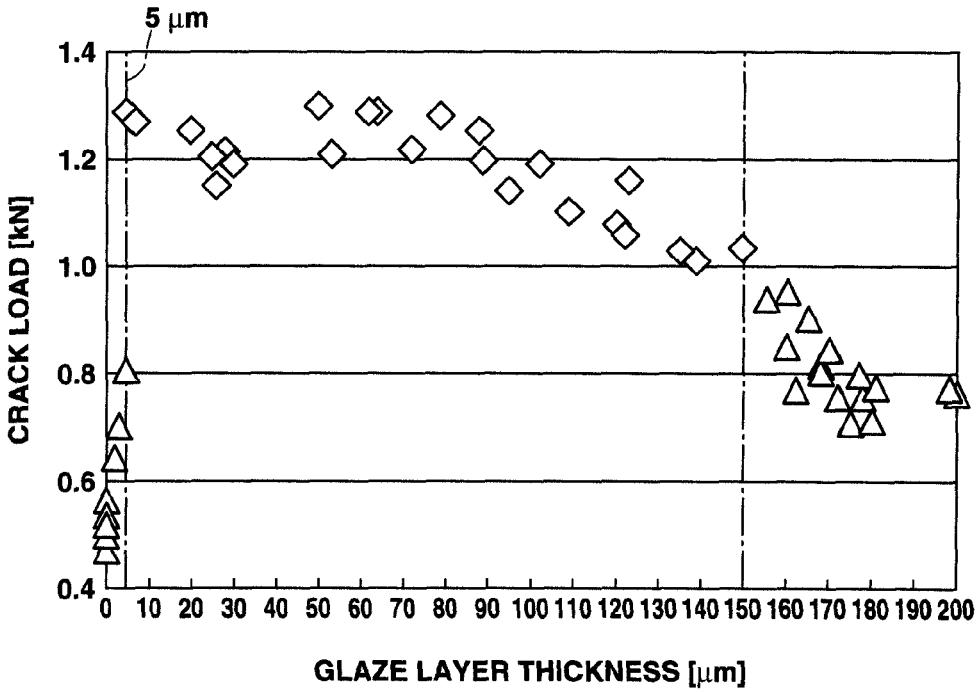
FIG. 5 is a graph of bending test results regarding a relationship of insulator crack position, crack load and first corner glaze thickness.

The test samples were subjected to bending strength test in the same manner as above. The test results are indicated in FIG. 5. In FIG. 5, the triangular plots indicate the occurrence of cracking in the rear shoulder section 23 of the ceramic insulator 2 and the quadrangular plots indicate the occurrence of cracking in the middle body portion 12 of the ceramic insulator 2. Further, the first corner glaze thickness of 0 mm means the absence of the rear glaze layer 28.

As shown in FIG. 5, the rear shoulder section 23 of the ceramic insulator 23 was cracked even under relatively small loads when the thickness of the first corner glaze section 43 was less than 5 μm. When the thickness of the first corner glaze section 43 exceeded 150 μm, the rear shoulder section 23 of the ceramic insulator 23 was also cracked even under relatively small loads. On the other hand, the crack was prevented from occurring in the rear shoulder section 23, but did occur in the middle body portion 12 of the ceramic insulator 2 under relatively large loads, when the thickness of the first corner glaze section 43 was in the range of 5 to 150 μm (preferably 10 μm or larger).

As a result of Experiments 1 and 2, it has been concluded that the ceramic insulator 2 can obtain sufficient strength improvement in the rear shoulder section 23 to withstand relatively large loads without cracking by the formation of the glaze layer 28 of appropriate thickness. It has been concluded from further studies that the strength improvement of the rear shoulder section 23 can be achieved effectively and efficiently by making the corner glaze section 43 thicker than the body glaze section 45. It has further been concluded that, by the formation of the glaze layer 29 in addition to the glaze layer 28, the ceramic insulator 2 can obtain sufficient strength improvements not only in the rear shoulder section 23 but also in the middle body portion 12 to withstand relatively large loads without cracking; and that the same thickness control of the second corner and body glaze sections 44 and 46 can provide the same strength improvement effects as of the first corner and body glaze section 43 and 45.

As described above, it is possible according to the present invention to impart a sufficient level of strength to the ceramic insulator 2 and prevent a cracking failure of the ceramic insulator 2 effectively and assuredly by forming the first and second glaze layers 28 and 29 on the ceramic insulator 2 and controlling the thickness of these first and second glaze layers 28 and 29 to within the above specific ranges.

The entire contents of Japanese Patent Application No. 2007-090183 (filed on Mar. 30, 2007) and No. 2008-006392 (filed on Jan. 16, 2008) are herein incorporated by reference.

Although the present invention has been described with reference to the above-specific embodiment of the invention, the invention is not limited to this exemplary embodiment. Various modification and variation of the embodiment described above will occur to those skilled in the art in light of the above teachings. For example, the spark plug 1 is not limited to the above single ground electrode configuration and may alternatively be provided with a multiple ground electrode configuration of e.g. two to four ground electrodes. The scope of the invention is defined with reference to the following claims.

What is claimed is:

1. A spark plug of an internal combustion engine, comprising:

an insulator having a through hole in an axial direction of the spark plug, the insulator including a rear body portion, a middle body portion and a large-diameter portion located between the rear and middle body portions and protruding radially outwardly from the rear and middle body portions, the large-diameter portion having a rear shoulder section connected at a rear end thereof to a front end of the rear body portion and a front shoulder section connected at a front end thereof to a rear end of the middle body portion;

a cylindrical metal shell retaining the middle body portion and the large-diameter portion of the insulator therein;

a center electrode fitted in the through hole of the insulator;

a ground electrode joined to the metal shell and having a given portion facing a front end of the center electrode to define a spark gap between the front end of the center electrode and the given portion of the ground electrode;

a first glaze layer formed on an outer surface of the insulator and extending over the rear body portion and the rear shoulder section of the large-diameter portion; and a second glaze layer formed on the outer surface of the insulator and extending over at least part of the middle body portion from some point on the front shoulder section of the large-diameter portion, wherein the first glaze layer includes a first corner glaze section to cover a corner between the front end of the rear body portion and the rear end of the rear shoulder section of the large-diameter portion and a first body glaze section to cover the rear body portion; and the first corner glaze section is larger in thickness than the first body glaze section.

2. The spark plug according to claim 1, wherein the second glaze layer includes a second corner glaze section to cover a corner between the rear end of the middle body portion and the front end of the front shoulder section of the large-diameter portion; and each of the first and second corner glaze sections has a thickness of 5 to 150 μm.

3. The spark plug according to claim 1, wherein the second glaze layer includes a second body glaze section to cover said at least part of the middle body portion; and each of the first and second body glaze sections has a thickness of 5 to 30 μm.

4. The spark plug according to claim 1, wherein the second glaze layer includes a second corner glaze section to cover a corner between the rear end of the middle body portion and the front end of the front shoulder section of the large-diameter portion and a second body glaze section to cover said at least part of the middle body portion; and the second corner glaze section is larger in thickness than the second body glaze section.

5. The spark plug according to claim 1, wherein the second glaze layer covers a part of the middle body portion kept from contact with an inner surface of the metal shell.

6. The spark plug according to claim 1, wherein the rear shoulder section has either a curved surface form, a continuous inclined surface form or a stepwise inclined surface form; and the front shoulder section has either a curved surface form or a continuous inclined surface form.

7. The spark plug according to claim 1, wherein an outer surface of the front shoulder section is spaced away from an inner surface of the metal shell.

8. The spark plug according to claim 1, wherein the insulator has a thickness of 1.65 mm or less at a corner between the rear end of the middle body portion and the front end of the front shoulder section of the large-diameter portion.

9. A spark plug of an internal combustion engine, comprising:

an insulator having a through hole in an axial direction of the spark plug, the insulator including a rear body portion, a middle body portion and a large-diameter portion located between the rear and middle body portions and protruding radially outwardly from the rear and middle body portions, the large-diameter portion having a rear shoulder section connected at a rear end thereof to a front end of the rear body portion and a front shoulder section connected at a front end thereof to a rear end of the middle body portion;

a cylindrical metal shell retaining the middle body portion and the large-diameter portion of the insulator therein;

a center electrode fitted in the through hole of the insulator;

a ground electrode joined to the metal shell and having a given portion facing a front end of the center electrode to define a spark gap between the front end of the center electrode and the given portion of the ground electrode;

a first glaze layer formed on an outer surface of the insulator and extending over the rear body portion and the rear shoulder section of the large-diameter portion; and a second glaze layer formed on the outer surface of the insulator and extending over at least part of the middle body portion from some point on the front shoulder section of the large-diameter portion, wherein the second glaze layer includes a second corner glaze section to cover a corner between the rear end of the middle body portion and the front end of the front shoulder section of the large-diameter portion and a second body glaze section to cover said at least part of the middle body portion; and the second corner glaze section is larger in thickness than the second body glaze section.

10. The spark plug according to claim 9, wherein the first glaze layer includes a first corner glaze section to cover a corner between the front end of the rear body portion and the rear end of the rear shoulder section of the large-diameter portion; and each of the first and second corner glaze sections has a thickness of 5 to 150 μm.

11. The spark plug according to claim 9, wherein the first glaze layer includes a first body glaze section to cover the rear body portion; and each of the first and second body glaze sections has a thickness of 5 to 30 μm.

12. The spark plug according to claim 9, wherein the second glaze layer covers a part of the middle body portion kept from contact with an inner surface of the metal shell.

13. The spark plug according to claim 9, wherein the rear shoulder section has either a curved surface form, a continuous inclined surface form or a stepwise inclined surface form; and the front shoulder section has either a curved surface form or a continuous inclined surface form.

14. The spark plug according to claim 9, wherein an outer surface of the front shoulder section is spaced away from an inner surface of the metal shell.

15. The spark plug according to claim 9, wherein the insulator has a thickness of 1.65 mm or less at a corner between the rear end of the middle body portion and the front end of the front shoulder section of the large-diameter portion.

* * * * *